US006238501B1

(12) United States Patent
Stec, III et al.

(10) Patent No.: US 6,238,501 B1
(45) Date of Patent: May 29, 2001

(54) TNAZ COMPOSITIONS AND ARTICLES, PROCESSES OF PREPARATION, TNAZ SOLUTIONS AND USES THEREOF

(75) Inventors: Daniel Stec, III; Rao C. Surapaneni, both of Long Valley; Brian E. Travers, Wayne, all of NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/334,235

(22) Filed: Jun. 16, 1999

Related U.S. Application Data

(60) Provisional application No. 60/089,713, filed on Jun. 18, 1998.

(51) Int. Cl.[7] ..... D03D 23/00; D03D 43/00; C06B 25/34; C06B 21/00

(52) U.S. Cl. ..... 149/109.6; 264/3.1; 264/3.2; 264/3.3; 264/3.4; 149/92; 149/11; 149/19.92; 149/19.1; 149/19.6

(58) Field of Search ..... 149/92, 11, 19.6, 149/19.1, 19.91, 19.92; 264/3.1, 3.2–3.3

(56) References Cited

U.S. PATENT DOCUMENTS

| | | | | |
|---|---|---|---|---|
| 5,529,649 | * | 6/1996 | Lund et al. | 149/19.3 |
| 5,565,150 | * | 10/1996 | Dillehay et al. | 264/3.3 |
| 5,587,533 | | 12/1996 | Braithwaite et al. . | |
| 5,716,557 | * | 2/1998 | Strauss et al. | 264/3.3 |
| 5,717,158 | * | 2/1998 | Capellos et al. | 149/19.4 |
| 5,759,458 | * | 6/1998 | Haaland et al. | 264/3.3 |
| 6,171,530 | * | 1/2001 | Haaland et al. | 264/3.2 |

* cited by examiner

*Primary Examiner*—Michael J. Carone
*Assistant Examiner*—Glenda L Sanchez
(74) *Attorney, Agent, or Firm*—Robert C. Beam; John F. Moran; Michael C. Sachs

(57) ABSTRACT

The invention is a composition containing high loadings of TNAZ that are made by crash precipitation with water as the precipitation agent. The compositions are in the form of powders, which can be formed and shaped by presseing, extrusion, etc. The TNAZ can be from about 94 to about 99% by weight of the composition.

1 Claim, No Drawings

TNAZ COMPOSITIONS AND ARTICLES, PROCESSES OF PREPARATION, TNAZ SOLUTIONS AND USES THEREOF

CROSS REFERENCE TO RELATED APPLICATION

This application is a continuation of Provisional Application Ser. No. 60/089,713, filed Jun. 18, 1998 and titled "TNAZ COMPOSITIONS AND ARTICLES, PROCESSES OF PREPARATION, TNAZ SOLUTIONS AND USES THEREOF". The benefit of the filing date is claimed herewith and the contents of the application are expressly incorporated herein as if fully set forth.

STATEMENT OF GOVERNMENT INTEREST

The United States Government has certain rights and licenses in this invention.

BACKGROUND OF THE INVENTION

High solids explosive compositions are desirable for use in explosive applications. They contain high solids loadings of energetic filllers such as HMX, Cl-20, TEX, TNAZ etc. U.S. Pat. No. 5,587,553 discloses certain compositions made by coacervation precipitation in which the precipitation agent is hexane. As described in the patent, there is a need for highly filled explosive compositions that can be pressed or extruded. This is the field to which the present invention is directed.

SUMMARY OF THE INVENTION

The invention is directed to compositions containing high loadings of TNAZ that are in the form of molding powders, the processes to prepare the powders, the pressed energetic shapes and forms made from the molding powders, articles made from the shapes and forms and ammunitions containing the articles. It also includes novel solutions comprising TNAZ, an elastomer having a polar region and a water-miscible organic solvent. The solutions may be used in the precipitation process of the invention for preparation of the molding powders or may be used for other purposes such as coating other crystalline energetic materials such as epsilon HNIW (CL-20) or HMX to provide enhanced crystals. The solution may also be used to coat metals and to coat aluminum for enhanced blast effect fillers.

DETAILED DESCRIPTION OF THE INVENTION

The powders with high loadings of TNAZ are made by a unique process of preparation. In the process, a solution of TNAZ, elastomer and water-miscible organic solvent is formed. This solution is contacted with water to cause the formation of a viscous liquid containing the TNAZ and elastomer which converts into the solid powder. The water-miscible organic solvent leaves the organic solution and goes into the liquid water phase. It causes the precipitation of the solid powders which have the TNAZ and binder associated in a manner that the powder can be used to form molded articles with high loadings of TNAZ. The precipitated powder can have as much as 99 wt % TNAZ and is useful as a molding powder according to the invention.

During the mixing of the water and the solution, the formation of the solid TNAZ/elastomer phase can be observed along with the density gradient that shows the separation of the water-miscible solvent and water from the solid phases. The separation of the viscous liquid and formation of the solid powders is termed crash precipitation for the purposes of this invention. Either the water phase or the organic phase may contain bead size control agents as are used in aqueous suspension polymerization systems. In some circumstances, the viscous phase will form a long thin layer which on continued stirring will redissolve and reform into the organic phase and then form the solid powders discussed above.

The TNAZ starting material does not have to be in any particular distribution of particle sizes because it will be dissolved. This is an advantage compared to molding materials which use HMX that need bi and polymodal particle size distributions. When forming the solution of TNAZ, elastomer and solvent, it is preferred to dissolve the ingredients with heating and then cool to room temperature. Any order of addition may be used. The volume ratios of solvent/TNAZ are not critical; ranges about 1 to 3 have been found suitable. The organic solvents are at least water-miscible and may be water soluble. The solvent dissolves the TNAZ and the elastomer to form the solution. A group of preferred solvents are acetone, methyl ethyl ketone, ethyl acetate and N-methyl pyrrolidone. This solution will be able to be the organic phase in the crash precipitation process.

For the precipitation of the solids in the form of the beads or powders, the solution is added to water at about 6 to 15 degrees C., 12 degrees C. has been suitable. The system is stirred and the precipitation begins to occur. The conversion of the system from the solution of TNAZ/elastomer/solvent to the system TNAZ/elastomer solid and solvent/water liquid can be followed visually. A viscous layer forms which is rich in TNAZ and elastomer. This continues to convert until the solid beads form. Typically the powders will be in the range of about 25 to about 300 microns. Over the range of particle sizes, the compositions are substantially uniform so that even the fines are used in the molding powders of this invention. The powders when subjected to DSC show a melting point for TNAZ but even at 600X under electron microscopy, there is no indication of TNAZ crystals as a separate phase in the powder.

Overall, the powders have at least about 94 wt % TNAZ and an elastomer with a polar region. The elastomer acts as a binder and as a result of the process of preparation, the powders are able to be used in molding processes. The compositions may contain energetic or non-energetic plasticizers, silicon dioxide and graphite. Also, the coating compositions for use in processes such as coating other crystalline energetic materials may contain conventional coating agents such as flow control agents. Typical plasticizers are isodecyl polarginate and dioctyl adipate.

The powders are especially useful for molding operations in which the powder is pressed at high pressure and relatively low temperature to form a shape. The shape may be used as such or it may be machined into another article. Because TNAZ is expensive relative to other energetic materials such as HMX, it is used in demanding applications where its special energetic properties are particularly useful. A typical example would be shaped charge munitions.

The molding powders of the invention are substantially free of large, visible, TNAZ crystals which tend to cause impact sensitive shock reactions. This is surprising in view of the high loadings that can be attained, TNAZ wt % of at least about 94%, at least about 98% and at least about 99%. The ranges of about 94 wt % TNAZ , from about 94 wt % to about 99 wt % TNAZ and from about 94 wt % to about 98 wt % TNAZ are particularly useful in making articles by extrusion. The elastomer having the polar region is also soluble in the water-miscible solvents which are used to dissolve the TNAZ. The elastomers may be alkyl acrylates, block copolymers of polyamides such as block copolymers of polyethers and polyamides and alkylated polyvinylpyrrolidones. Specific examples of the elastomers are HyTemp 4054 elastomer, PEBAX 2533 elastomer and GANEX V560 elastomer.

The molding powder compositions may contain other conventional ingredients such as plasticizers, silicon dioxide flow control agents and graphite. The coating compositions for use in coating other crystalline energetic materials may contain conventional coating agents. Typical plasticizers are isodecyl polarginate and dioctyl adipate.

Additional details about the practices of the processes, the powders, the molding of the powders into shapes and forms, the articles from the shapes and forms and the use of ammunition containing the articles is given in Attachment A, 16 pages, pA1-pA16 of Provisional Application 60/089,713 which is expressly incorporated herein by reference.

It can be seen that the invention provides molded articles with high loadings of TNAZ that are at very good TMD levels and high bulk densities can be reached. The powders mold very well and avoid cracking. The forms and shapes can be machined into articles and do not chip during this machining. It is also noteworthy that the invention provides benefits in economies of materials.

One noteworthy aspect of these economies of the invention are that if there is material from machining or defective parts such as cracked shapes or forms, these can be remelted and two phases will form. On solidification, the TNAZ will form one pure TNAZ phase and the elastomer will form its own separate phase which can literally be peeled from the TNAZ. Each can be reused and the TNAZ could be recycled. This usefulness of rejects and regrinds increases the economic advantage of the molding process of the invention.

It can be seen that the invention includes the processes, compositions, articles, ammunitions, and methods for the same that are within the skill of the art as well as the specific embodiments and examples presented above.

We claim:

1. A process for preparing a solid, powdered energetic composition comprising the steps of:

(a) forming a solution of 1,3,3-trinitroazetidine (TNAZ) and an elastomer having at least one polar region in a water-miscible organic solvent, wherein the amount of TNAZ present represents at least about ninety-four percent by weight (94.0 wt %) of the solute;

(b) contacting the solution of step (a) with water to permit the water-miscible solvent to migrate into the water phase, co-precipatating the TNAZ and elastomer as a single-phase solid, powdered energetic material without evidence of crystalline TNAZ; and, (c) recovering the solid, powdered energetic material.

* * * * *